US010731811B1

(12) United States Patent
Wu

(10) Patent No.: US 10,731,811 B1
(45) Date of Patent: Aug. 4, 2020

(54) SIMULATED CANDLE TIP

(71) Applicant: AE TECHNOLOGIES CO., LTD., Guangzhou, Guangdong (CN)

(72) Inventor: Wenfeng Wu, Guangdong (CN)

(73) Assignee: AE TECHNOLOGIES CO., LTD., Guangzhou (CN)

( * ) Notice: Subject to any disclaimer, the term of this patent is extended or adjusted under 35 U.S.C. 154(b) by 0 days.

(21) Appl. No.: 16/568,854

(22) Filed: Sep. 12, 2019

(30) Foreign Application Priority Data

Aug. 16, 2019 (CN) ..... 2019 2 1340835

(51) Int. Cl.
*F21S 10/04* (2006.01)
*F21S 6/00* (2006.01)
*F21Y 115/10* (2016.01)

(52) U.S. Cl.
CPC ..... *F21S 10/046* (2013.01); *F21S 6/001* (2013.01); *F21Y 2115/10* (2016.08)

(58) Field of Classification Search
CPC ..... F21S 10/046; F21S 6/001; F21Y 2115/10
See application file for complete search history.

(56) References Cited

U.S. PATENT DOCUMENTS 9,810,405 B2 * 11/2017 Yang ..... F21S 6/001
2014/0211499 A1 * 7/2014 Fong ..... F21S 9/02 362/558
2015/0036348 A1 * 2/2015 Dong ..... F21V 19/0025 362/293
2015/0109786 A1 * 4/2015 Li ..... F21V 9/30 362/277
2019/0032877 A1 * 1/2019 Chen ..... F21S 6/001

* cited by examiner

*Primary Examiner* — Anne M Hines

(57) ABSTRACT

The invention relates to the field of illumination technology and provides a simulated candle tip, which comprises a light source arranged in the flame base such that a light emitted by the light source can be projected through the reflecting chamber of the flame cover, to simulate real flames. By controlling the power on/off of the electromagnetic coil and the direction of current, attracting and repelling forces can be generated between the electromagnetic coil and the magnet, to enable the flame holder to perform regular swing motion in forward, backward, left and right directions. In this way, both the light source disposed at the upper end of the flame holder and the flame cover can perform swing motion along with the flame holder, to simulate flickering effect of real burning flames. In such case, a stable swing motion can be realized, and it is easy to control.

20 Claims, 2 Drawing Sheets

SIMULATED CANDLE TIP

CROSS-REFERENCE TO RELATED APPLICATION

The present application claims priority to and the benefit of Chinese Patent Application No. 201921340835.6 filed on Aug. 16, 2019, the entire content of which is hereby incorporated by reference.

FIELD OF THE INVENTION

The present invention relates to the field of illumination technology, more particularly to a simulated candle tip.

BACKGROUND OF THE INVENTION

Candles, which are conventional consumables for lighting, comprise the paraffin as the primary ingredient. The paraffin may be produced by cold press or solvent de-waxing waxy petroleum distillate. When a candle burns, the wax is constantly consumed and is not reusable, and harmful gases may be generated. Furthermore, a burning candle may be influenced by airflow, which may lead to flickering candlelight that helps to create a certain atmosphere. However, it may bring a risk of fire accidents.

With the rapid development of society, simulated flame lights which can simulate the burning flame and meanwhile meet safety and environmental protection requirements take the place of candles and are widely used to create atmosphere in various applications. However, existing simulated flame lights cannot well simulate flickering effect of the burning candle influenced by airflow and have poor simulation effect.

SUMMARY OF THE INVENTION

The present invention aims to provide a simulated candle tip which can realistically simulate the burning flame.

In order to solve the above problems, the present invention provides a simulated candle tip, which comprises a base part, a semitransparent flame cover, a light source, a swing support mechanism, and a swing driving mechanism, wherein the flame cover is provided with a reflecting chamber for reflecting light, a flame holder is arranged in the base part, an upper end of the flame holder extends outside the base part and is arranged with a flame base, a lower end of the flame cover is connected with the flame base, the light source is arranged in the flame base in such a manner that a light emitted by the light source can be projected through the reflecting chamber of the flame cover, and the swing driving mechanism is connected with a lower end of the flame holder and serves to drive the flame holder to swing around the swing support mechanism;

The swing driving mechanism comprises an electromagnetic coil and a magnet, wherein the magnet is arranged at the lower end of the flame holder, and the electromagnetic coil is arranged at a bottom of the base part and adjacent to the magnet.

Furthermore, the swing support mechanism may be preferably arranged in the base part, a swing convex point is provided on the swing support mechanism, a swing concave point is provided at a centre of gravity of the flame holder, the flame holder is hung on the swing convex point by the swing concave point, and the swing driving mechanism serves to drive the flame holder to swing around the swing convex point.

Furthermore, the swing support mechanism preferably may be cone shaped, and the flame holder may be hung on a top point of the swing support mechanism by the swing concave point.

Furthermore, the swing concave point preferably may be formed as a cone shaped concave point corresponding to the swing convex point.

Furthermore, the swing support mechanism preferably may comprise a mounting piece and a supporting element mounted in the mounting piece, wherein the mounting piece is connected with an inner wall of the base part and extends in a lower portion of the flame holder, and the top point of the swing support mechanism supports the flame holder at the swing concave point.

Furthermore, an upper end of the flame base preferably may be provided with an opened area, the opened area may be arc shaped or semicircle shaped, and the light source is arranged in the opened area.

Furthermore, an inner diameter of the flame cover is preferably gradually decreased from its lower end towards its upper end, and the lower end of the flame cover is detachably connected with the flame base.

Furthermore, the lower end of the flame cover is preferably detachably connected with the flame base by screw threads.

Furthermore, the light source preferably may be one LED lamp bead or a plurality of LED lamp beads arranged to be spaced apart in an axial direction of the flame cover.

Preferably, a control circuit may be further provided, the control circuit and the light source are electrically connected in a wired or wireless manner, and the control circuit serves to control luminance and/or flicker frequency of the light source.

The present invention provides a simulated candle tip, the flame cover is connected with the upper end of the flame base, and the light which is emitted by the light source arranged in the flame base can be projected from the flame base to the reflecting chamber of the flame cover, to simulate real flames. The light source and the flame cover cooperated with each other, taking the place of the flame sheet, reflect light to simulate the flame light source. Due to the swing driving mechanism connected with the lower end of the flame holder and used for driving the flame holder to swing around the swing support mechanism, the flame cover can be driven to perform swing motion to simulate flickering burning flame. In this way, the simulated flame effect is improved, and good use effect is ensured. In particular, by controlling the power on/off of the electromagnetic coil and the direction of current, attracting and repelling forces can be generated between the electromagnetic coil and the magnet. As the flame holder is hung on the swing support mechanism by the swing convex point, the flame holder can perform regular swing motion in forward, backward, left and right directions around the swing convex point when an attracting or repelling force is applied on the magnet. In this way, both the light source disposed at the upper end of the flame holder and the flame cover can perform swing motion along with the flame holder, to simulate flickering effect of real burning flames. In such case, a stable swing motion can be realized, and it is easy to control.

Figure 1:
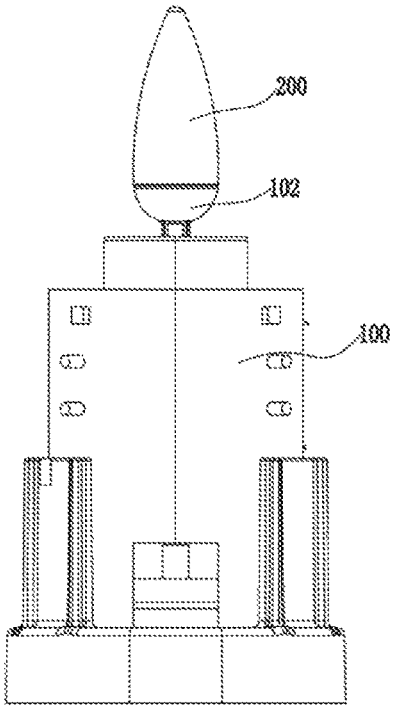
FIG. 1 is a schematic view of a simulated candle tip according to an embodiment of the present invention.
Figure 2:
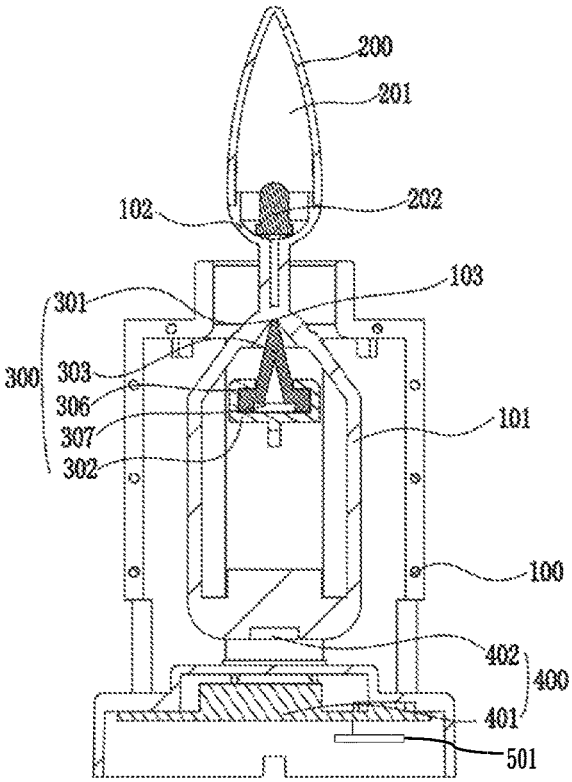
FIG. 2 is a schematic sectional view of a simulated candle tip according to an embodiment of the present invention.

In the drawings, 100. base part; 200. flame cover; 300. swing support mechanism; 400. swing driving mechanism; 101. flame holder; 102. flame base; 103. swing concave point; 104. base body; 105. cylinder halves; 106. cavity; 107. opening; 108. connecting protrusions; 109. connecting holes; 201. reflecting chamber; 202. LED lamp beads; 301. swing convex point; 302. mounting piece; 303. supporting element; 304. first portion; 305. second portion; 306. opening slot; 307. supporting piece; 401. electromagnetic coil; 402. magnet.

DETAILED DESCRIPTION OF ILLUSTRATED EMBODIMENTS

The invention will be further illustrated in the detailed description in conjunction with the drawings and the embodiments. The following embodiments are intended to illustrate the invention, but not to restrict the scope of the invention.

It should be understood that the terms, such as "up", "down", "left", "right", "top" and "bottom" as used in the description, refer to position and orientation relationships in accordance with drawings for convenience of description and for the purpose of simplicity. They are not intended to indicate or hint a limitation in terms of specific orientation or configuration and operation with specific orientation to the described device or element and should not be regarded as limiting.

FIGS. 1-4 schematically illustrate a simulated candle tip according to embodiments of the present invention. The simulated candle tip comprises a base part 100, a semitransparent flame cover 200, a light source, a swing support mechanism 300, and a swing driving mechanism 400, wherein the flame cover 200 is provided with a reflecting chamber 201 for reflecting light, and the reflecting chamber 201 serves to reflect the light emitted by the light source. Usually, the reflecting chamber 201 has a cylinder shaped structure, such that the light reflected at each position of chamber can be uniformly distributed, which ensures good use effect. A flame holder 101 is arranged in the base part 100, wherein the upper end of the flame holder 101 extends outside of the base part 100 and is arranged with a flame base 102, and the lower end of the flame cover 200 is connected with the flame base 102. The light source is arranged in the flame base 102 in such a manner that the light emitted by the light source can be projected through the reflecting chamber 201 of the flame cover 200. The swing driving mechanism 400 is connected with the lower end of the flame holder 101 and serves to drive the flame holder 101 to swing around the swing support mechanism 300. Preferably, the light source arranged inside the reflecting chamber 201 may be LED lamp beads.

In particular, the flame base 102 is arranged at the upper end of the flame holder 101, the flame cover 200 is connected to the flame base 102, and the light which is emitted by the light source arranged in the flame base 102 can be projected from the flame base 102 to the reflecting chamber 201 of the flame cover 200, to simulate real flames. Due to the swing driving mechanism 400 connected with the lower end of the flame holder 101 and used for driving the flame holder 101 to swing around the swing support mechanism 300, the flame cover 200 can be driven to swing to simulate flickering burning flame. In this way, the simulated flame effect is improved, and good use effect is ensured. Meanwhile, in the present embodiment, the swing driving mechanism 400 comprises an electromagnetic coil 401 and a magnet 402. In the embodiment, the electromagnetic coil 401 is electrically connected with a control circuit, the magnet 402 is arranged at the lower end of the flame holder 101, and the electromagnetic coil 401 is arranged at the bottom of the base part 100, adjacent to the magnet 402. In particular, by controlling the power on/off of the electromagnetic coil 401 and the direction of current, attracting and repelling forces can be generated between the electromagnetic coil 401 and the magnet 402. As the flame holder 101 is hung on the swing support mechanism 300 by the swing convex point 301, the flame holder 101 can perform regular swing motion in forward, backward, left and right directions around the swing convex point 301 when an attracting or repelling force is applied on the magnet 402. In this way, both the light source disposed at the upper end of the flame holder 101 and the flame cover 200 can perform swing motion along with the flame holder 101, to simulate flickering effect of real burning flames. In such case, a stable swing motion can be realized, and it is easy to control. Generally, a cylinder portion may be arranged at the lower end of the holder, and the magnet 402 may be embedded in the bottom of the cylinder portion.

In order to facilitate assembling and disassembling of the base part 100, the base part 100 may comprise a base body 104 and two cylinder halves 105, wherein the two cylinder halves 105 may be engaged with each other to form the cylinder body, the cylinder body may be mounted on the base body 104, a cavity 106 is formed in the cylinder body, the swing support mechanism 300 and the swing driving mechanism 400 are disposed in the cavity 106, the upper end of the cylinder body is provided with an opening 107, and the upper end of the flame holder 101 extends outside through the opening 107. In particular, the engagement end surface of one of the cylinders halves 105 (the end surfaces fitted to each other during the engagement of the two cylinder halves 105) is arranged with a plurality of connecting protrusions 108 evenly spaced from one another, the engagement end surface of the other one of the cylinders halves 105 is provided with a plurality of connecting holes 109 corresponding to the connecting protrusions 108, and the two cylinders halves 105 can be connected and fixed with one another by respective connecting protrusions 108 inserting in respective connecting holes 109.

Figure 3:
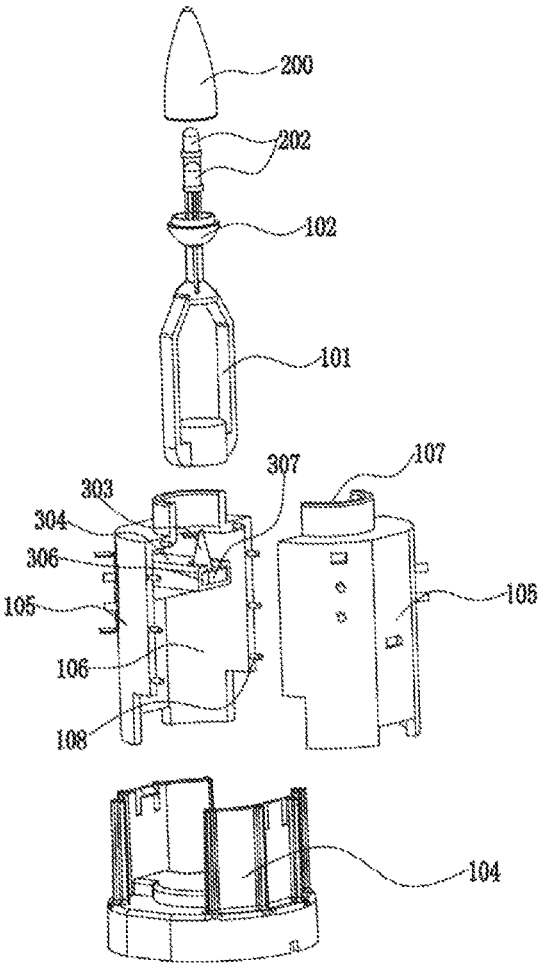
FIG. 3 is an exploded schematic view of a simulated candle tip according to an embodiment of the present invention.
Figure 4:
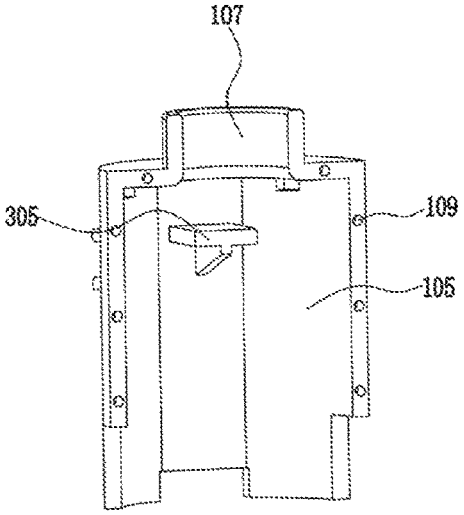
FIG. 4 is a schematic view of a cylinder half according to an embodiment of the present invention.

Furthermore, the swing support mechanism 300 may be arranged in the base part 100, the swing support mechanism 300 comprises a swing convex point 301, the flame holder 101 comprises the swing concave point 103, the flame holder 101 is supported at the swing concave point 103 by the swing convex point 301, and the swing driving mechanism 400 serves to drive the flame holder 101 to swing around the swing convex point 301. In such case, due to the point support between the flame holder 101 and the swing support mechanism 300 via which the swing motion is performed, the sensitivity of swing motion can be ensured. Once a small force is applied on the flame holder 101 by the swing driving mechanism 400, the flame holder 101 can be driven to swing around the swing convex point 301. Preferably, the swing support mechanism 300 may be cone shaped, and the flame holder 101 may be supported at the swing concave point 103 by means of the top point of the swing support mechanism 300. Furthermore, the swing support mechanism 300 may comprise a mounting piece 302 and a supporting element 303 mounted in the mounting piece 302, wherein the mounting piece 302 is connected with the inner wall of the base part 100 and extends in the lower portion of the flame holder 101, and the flame holder 101 is supported at the swing concave point 103 by the top point of the swing support mechanism 300. Preferably, the swing concave point 103 is formed as a cone shaped concave point corresponding to the swing convex point 301, to ensure stable swing motion. Referring to FIG. 3, the mounting piece 302 may comprise a first portion 304 and a second portion 305, one end of the first portion 304 is connected with the inner wall of one of the cylinder halves 105, and one end of the second portion 305 is connected with the inner wall of the other one of the cylinder halves 105. The first portion 304 is formed with an opening slot 306, and a supporting piece 307 fitting with the opening slot 306 is arranged at the lower end of the supporting element 303. When the two cylinder halves 105 are engaged with each other, the second portion 305 abuts against the supporting piece 307 such that the supporting piece 307 and the supporting element can be fixed in the opening slot 306.

Preferably, the lower end of the flame cover 200 is connected with the flame base 102, and the inner diameter of the flame cover 200 is gradually decreased from its lower end towards the upper end. That is, the flame cover 200 may have a cylinder shaped structure tapering from its lower end towards the upper end, to better conform to the shape of a candle flame. Due to the cylinder shaped structure of the flame cover 200, the light can be evenly reflected in the reflecting chamber 201, thus the viewing angle would not be limited. Alternatively, the flame cover 200 may be drop shaped, barrel shaped, and so on. Preferably, the upper end of the flame base 102 may be provided with an opened area, the opened area may be arc shaped or semicircle shaped, and the light source is arranged in the opened area. The lower end of the flame cover 200 is detachably connected with the flame base 102, to facilitate mounting, dismounting, and maintenance of the flame cover 200. Preferably, the lower end of the flame cover 200 is detachably connected with the flame base 102 by screw threads.

In the present embodiment, the light source may be one or more LED lamp beads 202. LED lamp beads 202 have many characteristics such as low power consumption, high luminance, beautiful colors, vibration resistance, and a long lifetime. Referring to FIG. 3, in the case that the light source comprises a plurality of LED lamp beads 202, the plurality of LED lamp beads 202 may be arranged to be spaced apart in the axial direction of the flame cover 200. In this way, light emitted from respective LED lamp bead can be mixed and reflected by the inner wall of the semitransparent flame cover 200 to generate various colors of light, thereby simulating real flame effects.

In the present embodiment, the simulated candle tip further comprises a control circuit 501 which is configured to control the power on/off of the electromagnetic coil 401 and the direction of current, to realize real time control of simulating flickering flame effect. The light source is electrically connected with the control circuit for controlling the luminance and/or flicker frequency of the light source. By means of the control circuit, the luminance of the light source can be controlled to simulate the flickering brightness of the flame, and the flicker frequency of the light source can be controlled to simulate the swing motion of the flame, whereby the simulated flame effect is improved, and good use effect is ensured. Generally, the control circuit and the light source are electrically connected in a wired or wireless manner.

Overall, the present invention provides the simulated candle tip. Herein, the flame cover 200 is connected with the flame base 102, and the light which is emitted by the light source arranged in the flame base 102 can be projected from the flame base 102 to the reflecting chamber 201 of the flame cover 200, to simulate real flames. Due to the swing driving mechanism 400 connected with the lower end of the flame holder 101 and used for driving the flame holder 101 to swing around the swing support mechanism 300, the flame cover 200 can be driven to swing to simulate flickering burning flame. In this way, the simulated flame effect is improved, and good use effect is ensured.

It should be understood that, in the present invention, terms such as "the first" and "the second" used herein for indicating various elements are merely intended to distinguish same type of elements from one another, but are not necessarily limited to these terms. For example, terms "the first" element may be referred to as "the second" element, and similarly, "the second" element may be referred to as "the first" element, without departing from the scope of the present invention.

The embodiments disclosed above are only preferred embodiments of the invention. It should be noted that for those skilled in the art, some improvements and alternatives can be made without departing from the principle of the invention, these improvements and alternatives should also be considered included within the scope of the invention.

The invention claimed is:

1. A simulated candle tip, comprising a base part, a semitransparent flame cover, a light source, a swing support mechanism, and a swing driving mechanism, wherein the flame cover is provided with a reflecting chamber for reflecting light, a flame holder is arranged in the base part, an upper end of the flame holder extends outside the base part and is arranged with a flame base, a lower end of the flame cover is connected with the flame base, the light source is arranged in the flame base in such a manner that a light emitted by the light source can be projected through the reflecting chamber of the flame cover, and the swing driving mechanism is connected with a lower end of the flame holder and is configured to drive the flame holder to swing around the swing support mechanism;

the swing driving mechanism comprises an electromagnetic coil and a magnet, wherein the magnet is arranged at the lower end of the flame holder, and the electromagnetic coil is arranged at a bottom of the base part and adjacent to the magnet.

2. The simulated candle tip according to claim 1, wherein the swing support mechanism is arranged in the base part, the swing support mechanism comprises a swing convex point, the flame holder comprises a swing concave point, the flame holder is hung on the swing convex point by the swing concave point, and the swing driving mechanism is configured to drive the flame holder to swing around the swing convex point.

3. The simulated candle tip according to claim 2, wherein the swing support mechanism is cone shaped, and the flame holder is hung on a top point of the swing support mechanism by the swing concave point.

4. The simulated candle tip according to claim 3, wherein the swing concave point is formed as a cone shaped concave point corresponding to the swing convex point.

5. The simulated candle tip according to claim 4, wherein an inner diameter of the flame cover is gradually decreased from its lower end towards its upper end, and the lower end of the flame cover is detachably connected with the flame base.

6. The simulated candle tip according to claim 4, wherein the light source comprises one LED lamp bead or a plurality of LED lamp beads arranged to be spaced apart in an axial direction of the flame cover.

7. The simulated candle tip according to claim 3, wherein the swing support mechanism comprises a mounting piece and a supporting element mounted in the mounting piece, wherein the mounting piece is connected with an inner wall of the base part and extends in a lower portion of the flame holder, and the top point of the swing support mechanism is configured to support the flame holder at the swing concave point.

8. The simulated candle tip according to claim 7, wherein an inner diameter of the flame cover is gradually decreased from its lower end towards its upper end, and the lower end of the flame cover is detachably connected with the flame base.

9. The simulated candle tip according to claim 7, wherein the light source comprises one LED lamp bead or a plurality of LED lamp beads arranged to be spaced apart in an axial direction of the flame cover.

10. The simulated candle tip according to claim 3, wherein an inner diameter of the flame cover is gradually decreased from its lower end towards its upper end, and the lower end of the flame cover is detachably connected with the flame base.

11. The simulated candle tip according to claim 3, wherein the light source comprises one LED lamp bead or a plurality of LED lamp beads arranged to be spaced apart in an axial direction of the flame cover.

12. The simulated candle tip according to claim 2, wherein an inner diameter of the flame cover is gradually decreased from its lower end towards its upper end, and the lower end of the flame cover is detachably connected with the flame base.

13. The simulated candle tip according to claim 2, wherein the light source comprises one LED lamp bead or a plurality of LED lamp beads arranged to be spaced apart in an axial direction of the flame cover.

14. The simulated candle tip according to claim 1, wherein an upper end of the flame base is provided with an opened area, the opened area is arc shaped or semicircle shaped, and the light source is arranged in the opened area.

15. The simulated candle tip according to claim 14, wherein an inner diameter of the flame cover is gradually decreased from its lower end towards its upper end, and the lower end of the flame cover is detachably connected with the flame base.

16. The simulated candle tip according to claim 15, wherein the lower end of the flame cover is detachably connected with the flame base by screw threads.

17. The simulated candle tip according to claim 14, wherein the light source comprises one LED lamp bead or a plurality of LED lamp beads arranged to be spaced apart in an axial direction of the flame cover.

18. The simulated candle tip according to claim 14, wherein a control circuit is further provided, the control circuit and the light source are electrically connected in a wired or wireless manner, and the control circuit is configured to control luminance and/or flicker frequency of the light source.

19. The simulated candle tip according to claim 1, wherein an inner diameter of the flame cover is gradually decreased from its lower end towards its upper end, and the lower end of the flame cover is detachably connected with the flame base.

20. The simulated candle tip according to claim 1, wherein the light source comprises one LED lamp bead or a plurality of LED lamp beads arranged to be spaced apart in an axial direction of the flame cover.

* * * * *